United States Patent [19]

Stein et al.

[11] 4,176,515

[45] Dec. 4, 1979

[54] ELECTRONIC CLOCK, PARTICULARLY A QUARTZ CLOCK

[75] Inventors: Manfred Stein, Eschborn; Dieter Busch, Rosbach, both of Fed. Rep. of Germany

[73] Assignee: Quarz-Zeit AG, Frankfurt am Main, Fed. Rep. of Germany

[21] Appl. No.: 839,615

[22] Filed: Oct. 5, 1977

[30] Foreign Application Priority Data

Oct. 9, 1976 [DE] Fed. Rep. of Germany ..... 2645744

[51] Int. Cl.[2] ..... G04C 21/16

[52] U.S. Cl. ..... 58/19 R; 58/85.5; 58/16 D

[58] Field of Search ..... 58/16 R, 16 D, 19 R, 58/38 R, 57.5, 85.5

[56] References Cited

U.S. PATENT DOCUMENTS

| | | | |
|---|---|---|---|
| 3,664,116 | 5/1972 | Emerson | 58/38 |
| 3,786,625 | 1/1974 | Sauthier | 58/85.5 |
| 3,822,547 | 7/1974 | Fujita | 58/57.5 |
| 3,852,951 | 12/1974 | Sauthier | 58/85.5 |
| 3,931,703 | 1/1976 | Scherrer | 58/85.5 |
| 3,946,549 | 3/1976 | Cake | 58/57.5 |
| 4,074,516 | 2/1978 | Kondo | 58/57.5 |

*Primary Examiner*—Gene Z. Rubinson
*Assistant Examiner*—Leonard W. Pojunas, Jr.
*Attorney, Agent, or Firm*—Martin A. Farber

[57] ABSTRACT

An electronic clock, particularly a quartz clock, with a timer signal transmitting stage, an indicator system which at least contains a minute counter and an hour counter, as well as a decoding stage and a digital indicator board, and an alarm system which at least contains a presettable counter associated with the minutes and a presettable counter associated with the hours, the outputs of which presettable counters are able to be locked on the indicator system, and a coincidence stage for comparison of the output signals of the counters of the indicator system with those of the alarm system. Each counter of the alarm system constitutes a forward-rearward-counter, and switches are provided for selection of the counting direction.

3 Claims, 3 Drawing Figures

ELECTRONIC CLOCK, PARTICULARLY A QUARTZ CLOCK

The invention relates to an electronic clock, particularly a quartz clock, with a timer signal transmitter stage, an indicator system which at least contains a minute counter and an hour counter, as well as a decoding stage and a digital indicator board, and an alarm system which at least contains a presettable counter device associated with the minutes and a presettable counter associated with the hours, the outputs of which are able to be locked on the indicator system, and a coincidence stage for comparison of the output signals of the counters of the indicator system with the output signals of the counters of the alarm system.

Known quartz clocks of this type have the disadvantage that the adjustment of the alarm time is cumbersome and first of all its truly time consuming. Thus the counter for the minutes and the counter for the hours of the alarm system can be adjusted or regulated depending on the construction of the time transmitting and time indicating part of the clock solely with a maximum speed of approximately one character per second. With an erroneous adjustment, as this can easily arise by inadvertence or carelessness, a nearly complete running through of the counter is necessary for a repeat of the adjustment and thus a considerable additional time expense.

This disadvantage should be avoided by the invention. It is therefore an object of the present invention to provide an electronic clock by which the desired alarm time can be quickly set in a simple manner. In addition to this the handling and operation should be as simple as possible.

It is another object of the invention, to aid the solution of the above mentioned object in the manner that starting out from a clock of the introductory described type, in accordance with the present invention each counter of the alarm system (5) is constructed as a forward-rearward running counter (14, 15) and switches (18, 19) are provided for selecting the direction of counting.

In this manner in accordance with the present invention the setting operation can be carried out many times more quickly than with the known clocks. In particular, erroneous settings may be quickly corrected by changes in the counting direction. A particular advantage of the solution in accordance with the invention resides in that the construction volume and the product costs as a result are only insignificantly increased.

According to one embodiment form of the invention, two push-button switches (25, 26) are coordinated to each forward-rearward-counter (14, 15). One of the two switches hereby serves for reversing the counting direction to forward- or rearward-counting, respectively, while by means of the other switch the counter is able to be applied with the count pulses.

In a preferred embodiment form one push-buton switch (18, 19) of the rocker type is coordinated to each forward-rearward-counter (14, 15). In this manner the operation in comparison to the previously described embodiment form is substantially simplified. Of a certain disadvantage is that with the use of one rocker type push-button switch, a forward-rearward-counter with two separated reversing inputs is required.

According to a further concept of the invention this disadvantage can be avoided with the last described embodiment form in accordance with the present invention in the manner that between the switches (18, 19) and the forward-rearward-counter (14, 15) there is arranged a control stage (20, 21) in integrated circuit construction, which control stage comprises a first anticoincidence member (22), one input of which is connected with the output of the switch and is connected with the other input over a resistor (24), and a second anticoincidence member (23), one input of which is connected with the output of the first anticoincidence member (22) and is connected to the count input of the forward-rearward-counter (14, 15), and the output of which is connected to the reversing input of the counter (14, 15), and both of the anticoincidence members (22, 23) are applied on their free inputs with the count pulses. Such a control stage permits the use of an inexpensive forward-rearward-counter with a single reversing input.

A further improvement in the handling and operation of the clock can be achieved in the manner that the counters (6-9, 14, 15) are connected via a reversing system (10) to the decoding stage (11). In a first condition or position of the reversing system the counters (6-9) of the indicator system are switched and operatively connected to the decoding stage and in a second position of the reversing system the counters (14, 15) of the alarm system (4) are switched and operatively connected to the decoding stage (11), and which reversing system contains means for the time delayed automatic reversing from the second position to the first position. In this manner it is guaranteed that a locking-on of the time controlled counters cannot be forgotten after setting of the alarm time.

With the above and other objects and advantages in view, the present invention will become more clearly understood in connection with the following detailed description of a preferred embodiment thereof, when considered with the accompanying drawings, of which:

Figure 1:
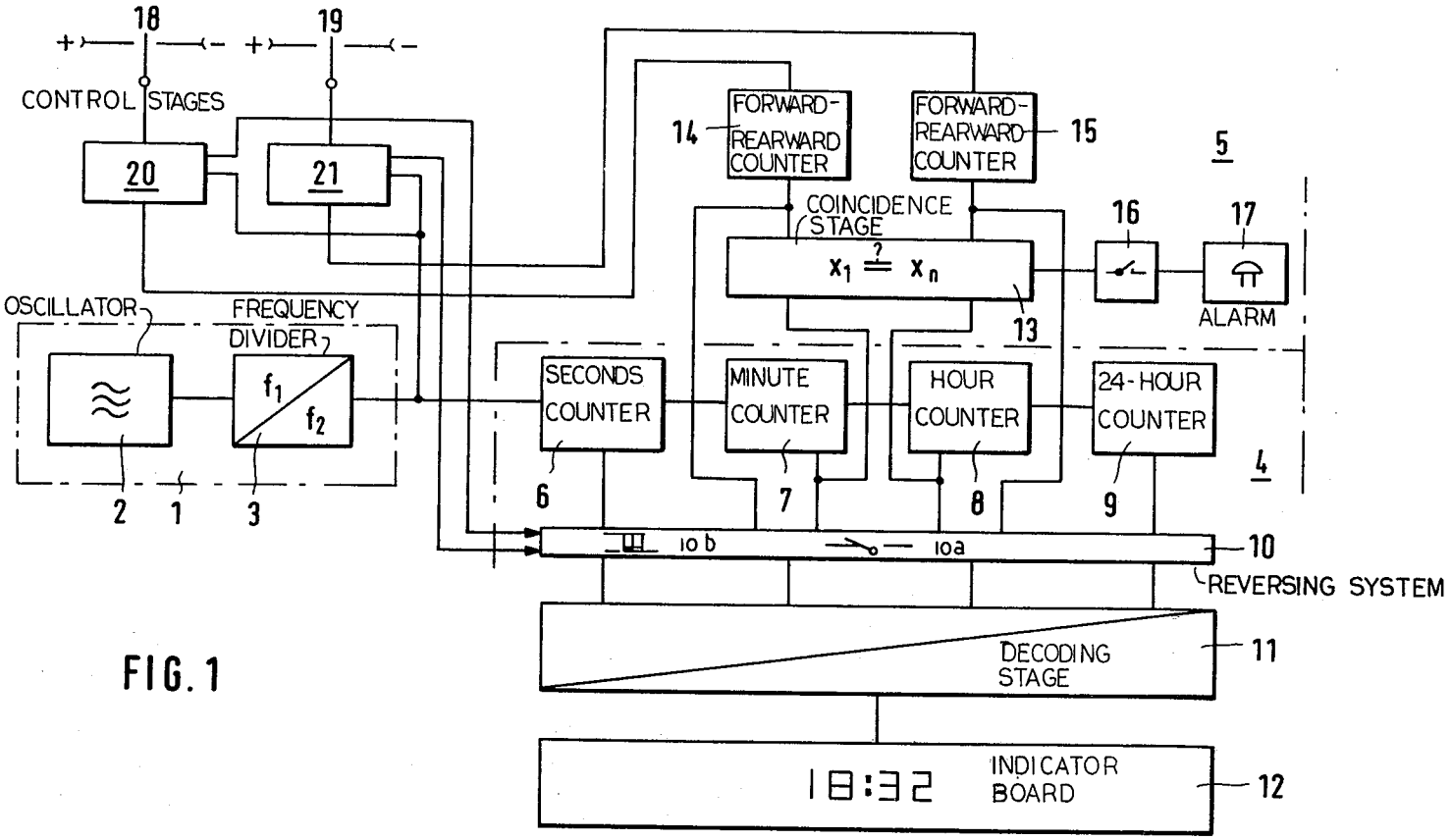
FIG. 1 is a schematic block circuit diagram of the clock.

Referring now to FIG. 1 of the drawings, the clock, of which merely the parts essential in cooperation with the invention are illustrated, comprises a time-signal transmitting or timer stage 1, which is made of a quartz oscillator 2 and a frequency divider 3, as well as an indicator system 4 and an alarm system 5.

The indicator system 4 contains a counter 6 for the seconds, a minute counter 7, an hour counter 8, and a 24 hour (day) counter 9, which counters over a changeover or reversing system 10 and a decoding stage 11 are able to be locked-on superimposed to a digital indicator board or screen 12. The minute counter 7 and the hour counter device 8 furthermore are connected to a coincidence stage 13 of the alarm system 5, the other two inputs of the coincidence stage being connected with a presettable forward-rearward-counter 14, the latter being associated with the minutes, and with a presettable forward-rearward-counter 15, respectively, the latter counter 15 being associated with the hours. The output of the coincidence stage 13 is connected to an alarm 17 via a switch 16. The setting of the forward-rearward-counters 14 and 15 are respectively brought about from time to time over a rocker type push-button switch 18 and 19, respectively, and a control stage 20 and 21, respectively.

Figure 2:
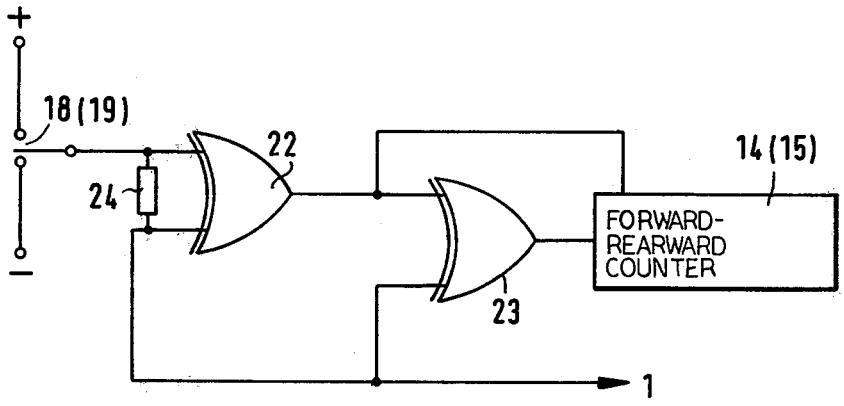
FIG. 2 is a circuit diagram of a control stage.

Each of the two control stages 20 and 21, respectively, contains two anticoincidence members 22 and 23 (FIG. 2). The anticoincidence member 22 is able to be applied on one input via the switch 18 with a positive potential (+), a zero potential (−), or without potential in the center inoperative neutral stopping position as illustrated in FIG. 2, and on the other input it can be applied with the count pulses from the timer stage 1. Both inputs are connected with one another over a high-ohm resistor 24.

The output of the anticoincidence member 22 on the one hand is connected to one of the inputs of the anticoincidence member 23 and on the other hand to the count inputs of the forward-rearward-counters 14 and 15, respectively. The other input of the anticoincidence member 23 is fed with the count pulses from the timer stage 1. The output of the anticoincidence member 23 is connected with the reversing or change-over input of the forward-rearward-counters 14 and 15, respectively.

The adjustment or setting of the desired alarm time according to the hours and the minutes takes place by a corresponding actuation of the rocker type push-button switches 18 and 19, whereby the time impulses constituting the count pulses (which time impulses are emitted from the timer stage 1) are read into the counters 14 and 15, respectively. The reading-in in the forward- or rearward- phase takes place depending upon the operative positioning of the switches 18 and 19, respectively. By operatively switching the rocker type push-button switch 18 or 19 to positive (+) or zero potential (−), count pulses appear at the output of the anticoincidence member 22 which are read into the counters 14 or 15. The count pulse signals at the output of the anticoincidence member 22 with a positive or zero potential actuation of the switches 18, 19 are reversed relative to each other, whereby the output from the anticoincidence member 23 and thus the reversing input of the counters 14 or 15 is held at a constant potential of either a low potential or a higher potential (+) depending upon a positive (−) or zero potential application of the switches 18, 19 thereby locking the counters either in the forward or rearward counting mode, simultaneously with the reading of the count pulses therein.

With the actuation of the switches 18 and 19, respectively, simultaneously the outputs of the counters 14 and 15 are switched and operatively connnected to the indicator screen or board 12 by means of the change-over or reversing system 10.

After reaching the desired setting of the alarm time the operator returns the respective switches 18, 19 into the neutral inoperative stopping position whereby no further count pulses are read-in the counters 14 and 15, and the reversing system 10 after a time delay of approximately 5 seconds automatically switches back to the counters 7 and 8 by switch back unit **10*a* so that again the clock time appears on the indicator board 12. Over the coincidence stage 13, now the number which has been read into the counters 14 and 15 is continuously compared with the number appearing at the output of the counters 7 and 8. With the agreement of both numbers, the alarm 17 is actuated if the switch 16** is closed—thus the alarm system effectively is switched.

Figure 3:
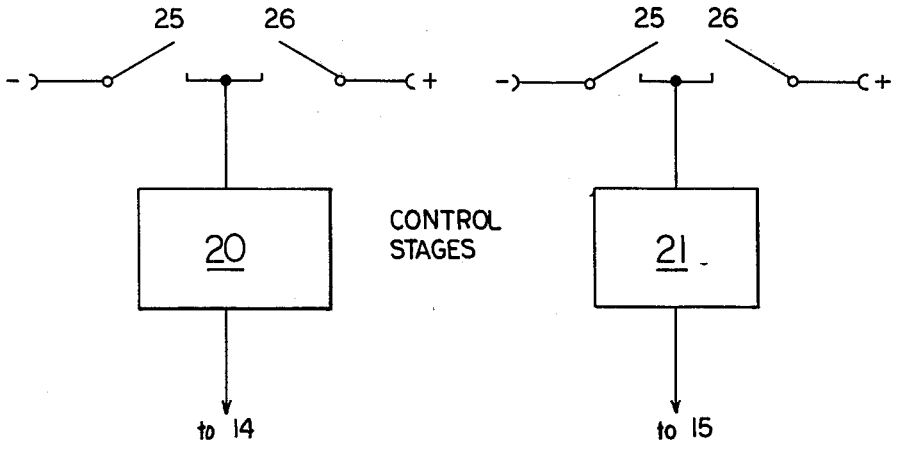
FIG. 3 is a schematic block circuit diagram of another embodiment illustrating two switches coordinated to each forward-rearward-counter.

FIG. 3 shows two push-button switches 25, 26 coordinated to each forward-rearward-counter 14, 15. One of the two switches hereby serves for reversing the counting direction to forward- or rearward-counting, respectively, while by means of the other switch the counter can be applied with the count pulses.

The reversing system 10 contains a monostable multivibrator **10*b* which is actuated in its quasistable state when the operator sets the alarm time. After setting, the monostable multivibrator 10*b* rests for few seconds in this state and after a predetermined time period the multivibrator 10*b* returns to its stable state and the switch back unit 10*a* is actuated to connect the counters 7 and 8 with the indicator board 12**.

While there has been disclosed one embodiment of the present invention, this embodiment is given by example only and not in a limiting sense.

We claim.

1. An electronic clock, particularly a quartz clock, comprising a timer transmitting stage means for providing timing count pulses, an indicator system connected to said timer transmitting stage means, said indicator system including at least a minute counter and an hour counter as well as a decoding stage operatively connected to said counters and a digital indicator board connected to said decoding stage, and an alarm system including at least a presettable counter associated with minutes and a presettable counter associated with hours, as well as a coincidence stage means.

each of said presettable counters having an output operatively lockable on said indicator system, said coincidence stage means for comparing output signals of said counters of said indicator system with output signals of said presettable counters of said alarm system, respectively, each of said presettable counters of said alarm system constitutes a forward-rearward-counter, and a plurality of switch means for selecting the direction of counting of said forward-rearward-counters, respectively, each said switch means comprises a rocker type push-button switch, one said rocker type push-button switch is operatively coordinated to each of said forward-rearward-counters, respectively, a control stage in integrated construction connected between one of said switch means and said forward-rearward-counters, respectively, said control stage comprises, a first anticoincidence member having two first inputs and a first output, one of said first inputs is connected with said one of said switch means, a resistor connected across said first inputs, a second anticoincidence member having two second inputs and a second output, one of said second inputs of said second anticoincidence member is connected to said first output of said first anticoincidence member, one of said forward-rearward-counters has a reversing input connected to said second output of said second anticoincidence member and a count input connected to one of said second inputs of said second anticoincidence member, the other of said first inputs and the other of said second inputs of said anticoincidence members are connected to said timer transmitting stage means and are applied with the timing count pulses.

2. An electronic clock, particularly a quartz clock, comprising a timer transmitting stage means for providing timing count pulses, an indicator system connected to said timer transmitting stage means, said indicator system including at least a minute counter and an hour counter as well as a decoding stage operatively connected to said counters and a digital indicator board connected to said decoding stage, and an alarm system including at least a presettable counter associated with minutes and a presettable counter associated with hours, as well as a coincidence stage means, each of said presettable counters having an output operatively lockable on said indicator system, said coincidence stage means for comparing output signals of said counters of said indicator system with output signals of said presettable counters of said alarm system, respectively, each of said presettable counters of said alarm system constitutes a forward-rearward-counter, and a plurality of switch means for selecting the direction of counting of said forward-rearward-counters, respectively, a reversing system means for operatively connecting all of said counters to said decoding stage, said reversing system means in a first position for switching and connecting said counters of said indicator system to said decoding stage, and in a second position for switching and connecting said counters of said alarm system to said decoding stage, and said reversing system means further for time delayed automatic changing-over from the second position to the first position, said presettable counters have count inputs operatively connected with said timer transmitting stage means via said plurality of switch means for operatively receiving count pulses, and said presettable counters have reversing inputs, respectively, said reversing system means is connected to said plurality of switch means, said plurality of switch means for triggering said reversing inputs with a different potential for selection of the direction of counting of said forward-rearward-counters, and for triggering said count inputs with the timing count pulses operatively from said timer transmitting stage means, and simultaneously for actuating said reversing system means into said second position.

3. The electronic clock, as set forth in claim 1, further comprising a reversing system means for operatively connecting all of said counters to said decoding stage, said reversing system means in a first position for switching and connecting said counters of said indicator system to said decoding stage, and in a second position for switching and connecting said counters of said alarm system to said decoding stage, and said reversing system means further for time delayed automatic changing-over from the second position to the first position.

* * * * *